US005115914A

United States Patent [19]

Dario

[11] Patent Number: 5,115,914

[45] Date of Patent: May 26, 1992

[54] CONTAINER FOR PLASTIC USED GLASSES

[75] Inventor: Luigi Dario, Montorso Vincentino, Italy

[73] Assignee: ATI SPA - Applicazioni Technologie Ad Iniezione, Montorso Vincentino, Italy

[21] Appl. No.: 711,089

[22] Filed: Jun. 6, 1991

[30] Foreign Application Priority Data

Jun. 8, 1990 [IT] Italy ..... 64288/90[U]

[51] Int. Cl.[5] ..... B65D 85/00

[52] U.S. Cl. ..... 206/499; 206/446; 220/909

[58] Field of Search ..... 220/254, 908, 909; 206/443, 445, 446, 499

[56] References Cited

U.S. PATENT DOCUMENTS

| | | | |
|---|---|---|---|
| 1,219,176 | 3/1917 | Sharp | 220/909 X |
| 2,185,328 | 1/1940 | Buttermann | 206/499 |
| 2,335,914 | 12/1943 | Buttery | 206/499 X |
| 2,771,216 | 11/1956 | Reiner | 206/499 X |
| 3,146,112 | 8/1964 | Weinstein | 206/499 X |
| 3,643,812 | 2/1972 | Mander et al. | 206/443 X |
| 3,788,487 | 1/1974 | Dawson | 206/499 X |
| 3,904,218 | 9/1975 | Kostic | 220/909 X |
| 4,789,062 | 12/1988 | Walsh | 206/427 |
| 4,826,012 | 5/1989 | Kosanovich | 206/499 |
| 4,997,102 | 3/1991 | Bolling | 220/325 |

*Primary Examiner*—Stephen Marcus
*Assistant Examiner*—Nova Stucker
*Attorney, Agent, or Firm*—Birch, Stewart, Kolasch & Birch

[57] ABSTRACT

A box for used plastic glasses includes a container (2,23), on the upper part of which there is a diaphragm (3,20), the surface (4) of which presents a plurality of holes (5,21). To each hole corresponds a guide (8,25) for guiding the glasses, which guide is constituted by one or more vertical elements, the guide projecting toward the inner part of the container (2,23). These guides (8,25) cause the piling up one into the other of a plurality of glasses (11) which are inserted into the holes (5,21) of the diaphragm by force of gravity.

15 Claims, 2 Drawing Sheets

CONTAINER FOR PLASTIC USED GLASSES

BACKGROUND OF THE INVENTION

The invention concerns the realization of a container for plastic used glasses.

It is known that in public offices, hospitals and meeting-places for communities, vending machines can easily be found for such drinks as coffee and tea. Drinks are served in throwaway glasses made of plastic. After use, the glasses are thrown into containers, usually dustbins, situated beside the vending machine.

Most of all in large communities, like hospitals or those firms where many dispensations are performed, the elimination of the used glasses causes a number of problems. The first problem is given by the considerable volume of the amount of glasses, since they are thrown into the dustbin helter-skelter. In the dustbin a sack is generally arranged in which the used glasses are collected, so that, when the sack is full, it is easy to pull it out with one single movement. In case a high number of dispensations is performed, it is obvious that the used glasses collected inside the sack helter-skelter take up a considerable volume and, consequently, many sacks are filled. Furthermore, in those firms where the elimination of refuse is carried out by skilled firms whose invoice prices depend on the volume of eliminated refuse, the elimination of large volumes of plastic used glasses affects remarkably the total cost of the elimination.

SUMMARY OF THE INVENTION

In order to overcome these problems, a box for plastic used glasses according to the invention is realized. The main purpose of the container is the reduction in volume of the used glasses at a parity of collected glasses.

Another purpose of the invention is the cost reduction for the removal and the elimination of the used glasses at a parity of collected glasses.

the above-mentioned purposes and other which will be better understood hereafter are reached with the realization of a box for plastic used glasses which claim, comprises a container and a diaphragm fitted in the upper part of the container, characterized in that the diaphragm surface presents a plurality of holes. To each hole corresponds a guide for guiding the glasses, said guide being formed of one or more vertical elements and projecting toward the inner part of the container, whereby said guides cause the piling up one into the other of a plurality of glasses inserted into the diaphragm holes by force of gravity.

According to a preferred embodiment of the box according to the invention, the vertical guides for guiding the glasses are tubes with a circular cross-section, each tube being glued to a corresponding hole of the diaphragm. The glasses are introduced into the tubes through the diaphragm holes and are piled up one into the other. Each pile of glasses rests at the bottom of the plastic container, inside which a plastic sack was previously arranged, the rim of which is wound round the upper rim of the container. The central part of the diaphragm surface presents a slit which communicates with the inner part of the container and through which small spoons are introduced.

According to another form of execution, each tube is jointed to its corresponding diaphragm hole through a pressure connection with a cone-shaped element protruding toward the inside of the container and belonging to the hole.

Advantageously according to the invention a box for glasses is realized which permits the user to cut down expenses regarding both the removal of the sacks full of used glasses and their elimination.

BRIEF DESCRIPTION OF THE DRAWINGS

The above-mentioned purposes and advantages will be better explained by the description of a preferred form of execution of the container according to the invention, which is given by way of example only and which is seen in the drawings, wherein.

Figure 2:
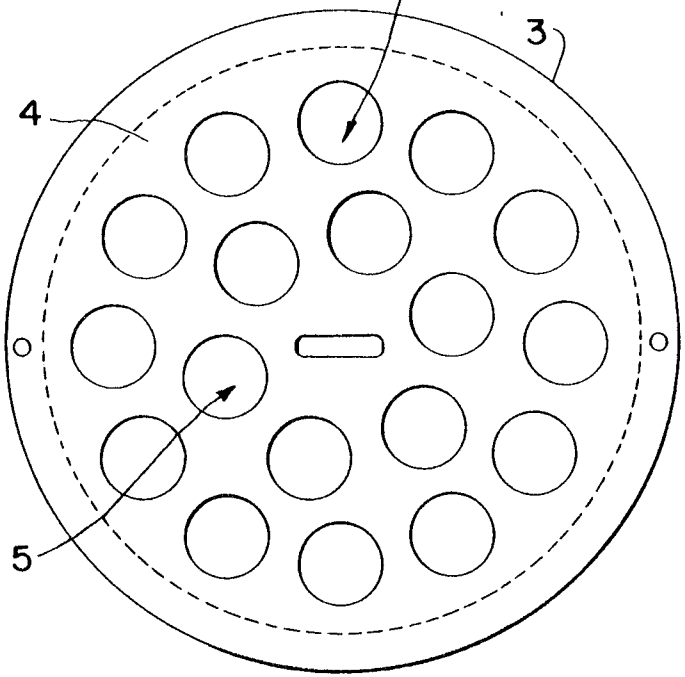
FIG. 2 shows a top view of the diaphragm of the container and the holes to which the tubes are fixed.
Figure 1:
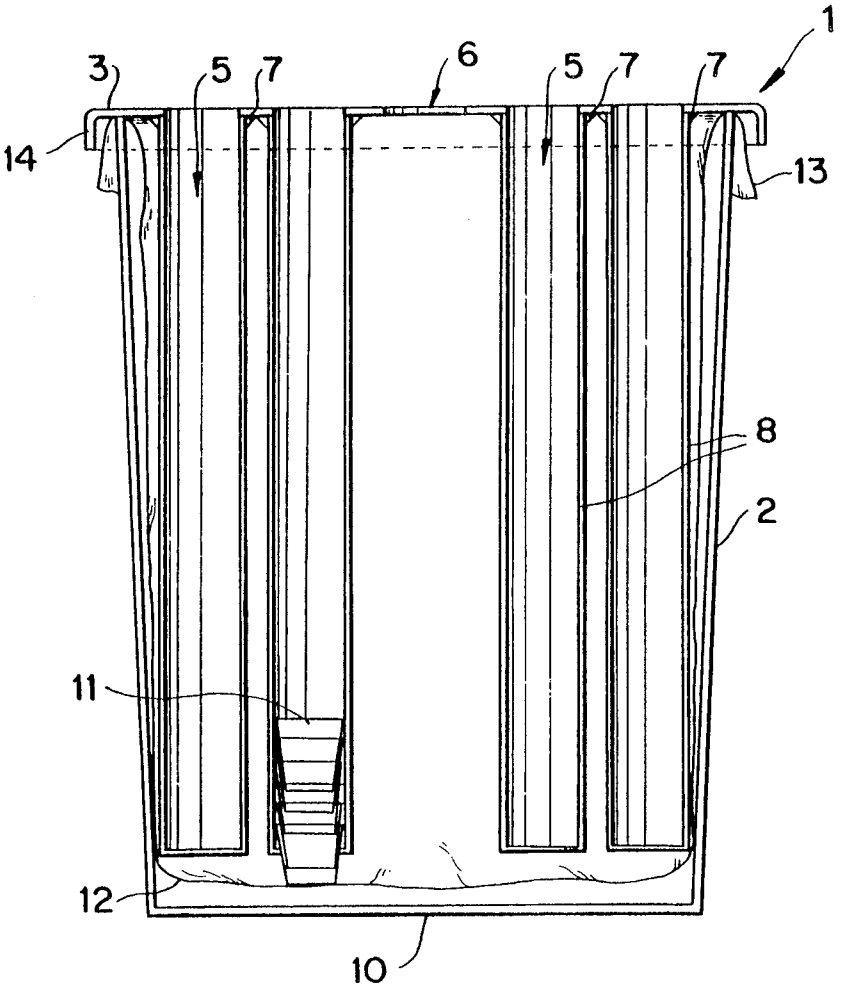
FIG. 1 shows a longitudinal cross-section of the box according to the invention.

As can be seen in FIG. 1, the box according to the invention which is indicated as a whole with 1, comprises a container 2, on the upper part of which a diaphragm 3 is applied which, as is better seen in FIG. 2, presents a plurality of holes 5 on its surface 4, said holes having a circular cross-section. In correspondence to each circular hole 5, a tube 8 is fixed by means of glue 7, said circular hole having the same circular cross-section as that of the hole 5. Said tubes 8 have a slightly larger internal diameter than the diameter of the glasses 11, so that the glasses can be easily introduced. Moreover, in the central part of the diaphragm 3 there is a slit 6 for the introduction of little spoons.

If one wants the container to be ready for use, a sack 12 must be arranged inside the container 2, the upper rim of which is fixed to the rim 14 of the container 2. The diaphragm 3 is then put in its former position placed on the rim 14 of the container 2 through the holes 5. As can be seen in FIG. 1, the glasses pile up one into the other guided by the walls of the tubes 8 in which they are contained. Thus, the piles of glasses rest on the bottom 10 of the container 2, though there is the interposition of the sack 12. Through the slit 6, plastic small spoons are introduced inside the container 2 and, consequently, inside the sack 12.

When all the tubes 8 are full of glasses, the worker who is charged with the elimination of refuse lifts the diaphragm 3 and draws it out in such a way that glasses 11, which are piled up vertically one into the other, remain well set up into separate columns. The worker then lifts the top portion 13 of the sack 12 from the rim 14 of the container 2, and pulls it out of the container 2. A fresh sack is put inside the container 2, the diaphragm 3 is settled around the rim 14 of the container 2 and the box 1 is ready to be used again.

Figure 4:
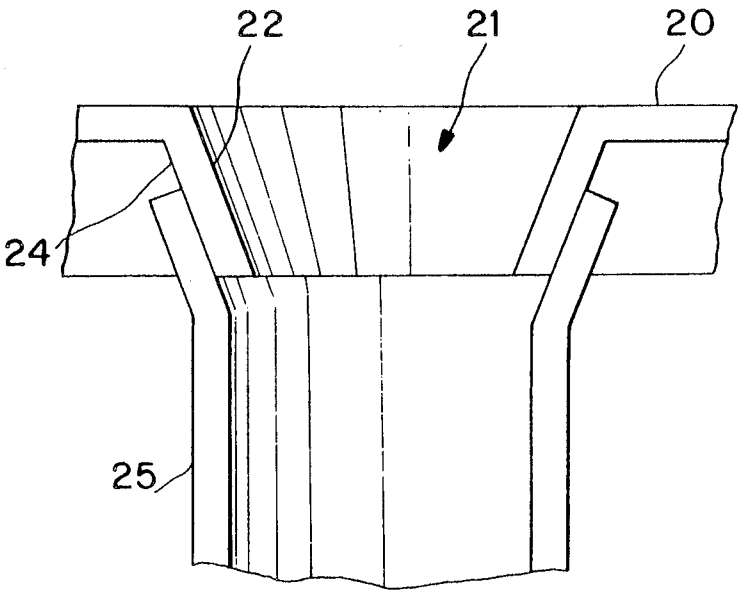
FIG. 4 shows an enlarged detail of the cone-shaped element of the embodiment of FIG. 3
Figure 3:
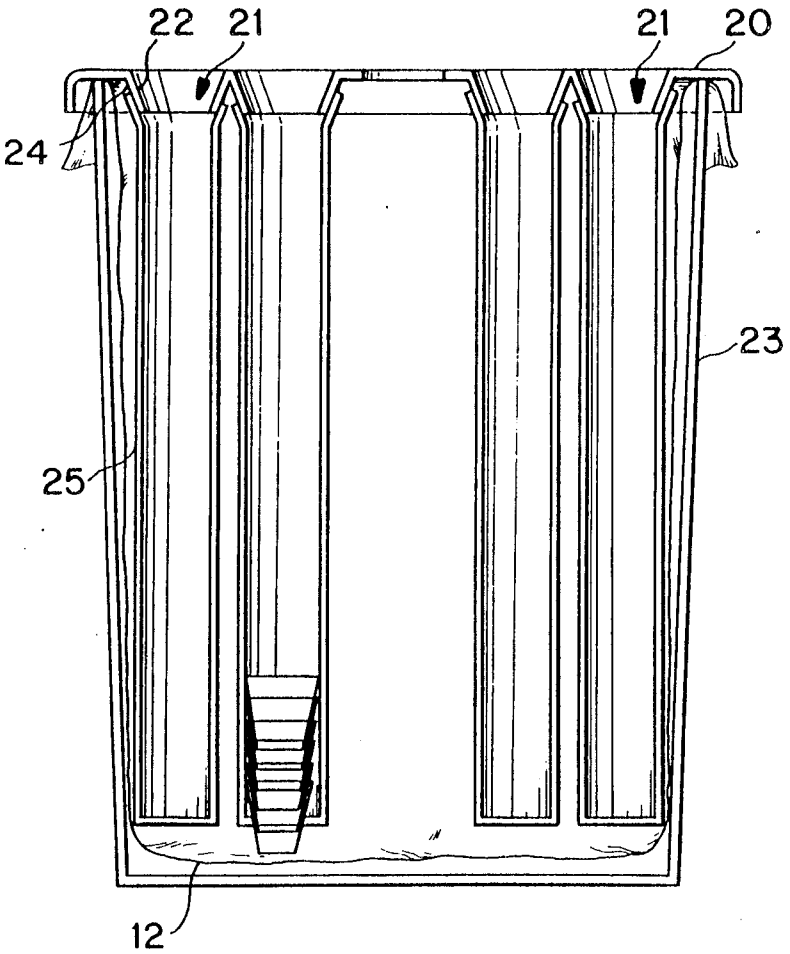
FIG. 3 shows an alternative embodiment of the invention in which the tubes are in connection with the diaphragm holes through cone-shaped elements belonging to the holes.

An alternate embodiment of the invention can be seen in FIG. 3, in which the holes 21 of the diaphragm 20 are fitted with a tubular cone-shaped element 22 turned toward the interior of the container 23, as can be seen in the detail of FIG. 4. Said cone-shaped elements 22 have a circular cross-section and their cone-shaped external surface 24 is convergent, so that each tube 25 can be fixed to the diaphragm 20 externally matched to a tubular cone-shaped element 22 by pressure.

According to what has been described, it is understood that the box 1 of the invention fulfills the mentioned purposes. In fact, the main purpose is reached to reduce the volume of the used glasses in the box. It is well understood that a better use of the volume at disposal is guaranteed when the glasses are piled up one into the other by the tubes rather than being thrown helter-skelter into the sack placed inside the container. Experimental tests have proved that the volume resulting from the accumulation of the glasses can be reduced to ⅛ of the previous volume at a parity of number of glasses.

the purpose has also been reached to reduce the costs of both the elimination of glasses and of the sacks removal, since the number of sacks and, consequently, the volume of refuse to be eliminated, is smaller.

A number of variations can be made to the box of the invention, for example regarding the container shape, the diaphragm shape and, the number and sizes of the holes through which the glasses are introduced.

Moreover, each tube may be jointed to its corresponding diaphragm hole either through a joint or a ring nut.

As regards the guides for piling up the glasses vertically, it has already been said that they can be formed of a frame structure applied to each diaphragm hole. Said guides may even be formed of one or more vertical staffs, applied to the diaphragm in correspondence with the hole periphery. Furthermore, the diaphragm may also be fitted with a lid. It is however understood that all these possible variations are to be considered within the scope of the present invention.

I claim:

1. A box for disposing of plastic glasses, comprising:

a container;

a diaphragm attached to an upper part of said container, said diaphragm having a plurality of openings in its surface;

a plurality of vertically-oriented guide elements attached to and extending from said diaphragm and projecting into an interior of said container, each of said guide elements corresponding to one of said openings in the diaphragm, whereby plastic glasses inserted into said container through said openings in the diaphragm are guided by said guide elements and fall into nested stacks.

2. The box for disposing of plastic glasses of claim 1, wherein said diaphragm and said guide elements comprise a single piece.

3. The box for disposing of plastic glasses of claim 1, wherein each of said guide elements is welded to said diaphragm such that each guide element is aligned with one of said openings in the diaphragm.

4. The box for disposing of plastic glasses of claim 1, wherein said diaphragm has a plurality of cone-shaped elements, one of said cone-shaped elements being associated with each of said openings in the diaphragm, such that each cone-shaped element forms a joint between said diaphragm and each of said guide elements.

5. The box for disposing of plastic glasses of claim 1, wherein said guide elements comprise tubes with circular cross-sections.

6. The box for disposing of plastic glasses of claim 1, further comprising a slit in a central part of said diaphragm, whereby small spoons can be deposited into said container through said slit.

7. The box for disposing of plastic glasses, comprising:

a container;

a diaphragm attached to an upper part of said container, said diaphragm having a plurality of openings in its surface;

a plurality of vertically-oriented guide elements extending from said diaphragm and projecting into an interior of said container, each of said guide elements corresponding to one of said openings in the diaphragm;

said diaphragm and said guide elements comprising a single piece, whereby plastic glasses inserted into said container through said openings in the diaphragm are guided by said guide elements and fall into nested stacks.

8. The box for disposing of plastic glasses of claim 7, wherein said guide elements comprises tubes with circular cross-sections.

9. The box for disposing of plastic glasses of claim 7, further comprising a slit in a central part of said diaphragm, whereby small spoons can be deposited into said container through said slit.

10. The box for disposing of plastic glasses, comprising:

a container;

a diaphragm attached to an upper part of said container, said diaphragm having a plurality of openings in its surface;

a plurality of vertically-oriented guide elements extending from said diaphragm and projecting into an interior of said container, each of said guide elements corresponding to one of said openings in the diaphragm;

each of said guide elements being welded to said diaphragm such that each guide element is aligned with one of said openings in the diaphragm, whereby plastic glasses inserted into said container through said openings in the diaphragm are guided by said guide elements and fall into nested stacks.

11. The box for disposing of plastic glasses of claim 10, wherein said guide elements comprise tubes with circular cross-sections.

12. The box for disposing of plastic glasses of claim 10, further comprising a slit in a central part of said diaphragm, whereby small spoons can be deposited into said container through said slit.

13. The box for disposing of plastic glasses, comprising:

a container;

a diaphragm attached to an upper part of said container, said diaphragm having a plurality of openings in its surface;

a plurality of vertically-oriented guide elements extending from said diaphragm and projecting into an interior of said container, each of said guide elements corresponding to one of said openings in the diaphragm;

said diaphragm having a plurality of cone-shaped elements, one of said cone-shaped elements being associated with each of said openings in the diaphragm, such that each cone-shaped element forms a joint between said diaphragm and each of said guide elements, whereby plastic glasses inserted into said container through said openings in the diaphragm fall into nested stacks guided by said guide elements.

14. The box for disposing of plastic glasses of claim 13, wherein said guide elements comprise tubes with circular cross-sections.

15. The box for disposing of plastic glasses of claim 13, further comprising a slit in a central part of said diaphragm, whereby small spoons can be deposited into said container through said slit.

* * * * *